US005902189A

United States Patent [19]

Schultz

[11] Patent Number: 5,902,189

[45] Date of Patent: May 11, 1999

[54] GOLF SWING TRAINING DEVICE

[75] Inventor: Gregory G. Schultz, 2124 McKinley Rd., Atlanta, Fulton County, Ga. 30318

[73] Assignee: Gregory G. Schultz, Atlanta, Ga.

[21] Appl. No.: 09/064,244

[22] Filed: Apr. 22, 1998

[51] Int. Cl.[6] ..... A63B 69/36

[52] U.S. Cl. ..... 473/212; 473/276

[58] Field of Search ..... 473/212, 276; 273/DIG. 30

[56] References Cited

U.S. PATENT DOCUMENTS

| | | | |
|---|---|---|---|
| 1,655,092 | 1/1928 | Davis . | |
| 3,339,926 | 9/1967 | Coupar | 273/183 |
| 3,672,682 | 6/1972 | Yanagidaira | 273/189 |
| 4,239,228 | 12/1980 | Norman et al. | 273/189 |
| 4,896,887 | 1/1990 | Cable | 273/189 |
| 5,040,798 | 8/1991 | Leitao | 273/183 |
| 5,076,587 | 12/1991 | Manley | 273/183 |
| 5,085,437 | 2/1992 | Leitao | 273/183 |
| 5,145,179 | 9/1992 | Breed | 473/212 |
| 5,248,146 | 9/1993 | Viets et al. | 273/189 |
| 5,259,621 | 11/1993 | Keefer | 473/212 |
| 5,295,690 | 3/1994 | Johnson | 273/187.2 |
| 5,447,312 | 9/1995 | Nixon et al. | 273/187.2 |
| 5,501,464 | 3/1996 | Dalbo | 273/187.2 |
| 5,529,306 | 6/1996 | Staats et al. | 473/208 |

*Primary Examiner*—George J. Marlo

*Attorney, Agent, or Firm*—Thomas, Kayden, Horstemeyer & Risley, L.L.P.

[57] ABSTRACT

The present invention provides a golf swing training device which allows the angular relationship of the leading and trailing forearms with respect to each other to change during the golf swing while substantially maintaining the distance between the forearms at the points at which the training device is attached to the forearms. The device comprises a first strap which attaches to the leading forearm below the elbow and above the wrist, a substantially rigid spacing member that is attached to the leading forearm strap by means of an articulating joint, and a second strap attached to the other end of the spacing member which attaches to the trailing forearm below the elbow and above the wrist. The spacing member preferably is adjustable in length to accommodate different distances between the forearms. The device promotes a one-piece takeaway and a unified, "on plane" position throughout the swing and at impact, while allowing the relative angular position of the forearms to change so that the trailing elbow rides free to train the golfer to make a full, unrestricted shoulder turn.

6 Claims, 3 Drawing Sheets

GOLF SWING TRAINING DEVICE

TECHNICAL FIELD OF THE INVENTION

The invention relates to the field of golf training devices and, more particularly, to a golf training device that trains the trainee to swing the golf club on a single plane using a full shoulder turn throughout the golf swing by connecting the upper forearms of the trainee and maintaining them a predetermined distance apart while allowing for the natural rotation of the forearms and wrists and the concomitant change in skew angles between the forearms and wrists during the golf swing.

BACKGROUND OF THE INVENTION

Various training devices have been conceived for teaching golfers how to properly execute the full golf swing. Several training devices are known which attempt to maintain a predetermined distance between the forearms. None of these know devices, however, provide a self-adjusting 360° pivoting joint to compensate for forearm angulation and attachment at a point just below and within both forearms to allow for a full shoulder turn on the back swing, as is the case with the present invention.

For example U.S. Pat. No. 4,896,887 to Cable discloses a tubular yoke which attaches by means of straps on the upper or lower surface of the upper arms, above the elbows. This device, while restricting the forearms, appears to restrict a full shoulder turn because of its placement above the elbows. Additionally, placement of the spacing member on the outside of the arms appears to hamper full contraction of the right elbow and consequently shortens the swing.

U.S. Pat. No. 5,447,312 to Nixon, et. al., also restricts the forearms by means of wedge-shaped device attached between the wrists. While one embodiment of the device allows for separate skew angles of the forearms, the selected position is locked at address. The golf swing is dynamic and the device appears to make no provision for the increasing angulation between the forearms which occurs during the back swing or for the corresponding reduction in angulation which occurs on the forward swing.

U.S. Pat. No. 5,501,464 to Dalbo uses a semi-rigid, triangular guide member with its apex at the wrists and a base portion running up each forearm. Torque created during the down swing may thus cause a reduction in the spacing between the arms due to the semi-rigidity of the spacing member. The device does not provide a strap for attachment to the leading forearm. Without a restraint to maintain positive contact with both arms, the wearer is not encouraged to make a complete shoulder turn for fear of losing contact with the device. Also, while the device allows for independent angulation of the forearms, the angulation is fixed at address.

Golf is a difficult sport to master for the person of only average athletic ability and limited opportunity for instruction and practice. The golf swing is best learned through repetition of the proper moves, so that muscle memory is created. While an understanding of the mechanics is helpful, the golfer should strive to remember the "feel," rather than the "mechanics," of a good swing. However, repetition of an incorrect technique is a real danger without vigilant supervision by a teaching professional. The constraints to such an arrangement for the player of average means are obvious.

Accordingly, a training aid is needed which teaches the golfer to swing the golf club along a fixed path or plane around the axis presented by the spine, while allowing for the natural rotation and change in angulation of the forearms on both the back and forward swings. In accordance with these objectives, the training device of the present invention comprises a rigid spacing member that produces a consistent swing plane by maintaining a substantially fixed spacing between the forearms, but which allows for the natural rotation and change in angulation of the forearms on both the back and forward swings.

Swinging the golf club on plane is essential for consistent golf shots. The elbows should stay in their address relationship throughout the swing. The skew angle of the axes defined by the golfer's forearms is greatest at the apex (i.e. at the wrists) of the triangle formed by the hands, arms and shoulders. Moreover, this angulation is dynamic and changes during the swing. The angulation becomes most severe at the top of the back swing where a 45° to 90° skew between the wrists is presented, which may vary among individuals. Thus, the device of the present invention preferably mounts on the inside of the forearms, just below the elbows, where the opposing surfaces of the arms remain relatively square throughout the swing. The device of the present invention preferably has a 360° pivoting connection at the point at which the lead forearm is coupled to the spacing member, to thereby maintain a perpendicular relationship with the forearms, so as to efficiently transfer energy from the trailing shoulder and arm through the spacing member and into the leading shoulder and arm, through the golf club, and into the ball at impact.

Equally important is that both shoulders, and in particular the leading shoulder, turns fully through impact and at the same speed as the trailing shoulder and arms. The full swing has been described by some as an "exaggerated putt". It is well known that the ideal putting stroke is pendulum in nature, with both shoulders and both arms moving at the same rate of speed (i.e. together) throughout the putting stroke. Similarly, it is essential that the shoulders and arms turn together throughout the full golf swing. The training device of the present invention comprises a strap on each end of the spacing member for fastening the spacing member about the forearms which enables the shoulders and arms to turn together throughout the full golf swing.

Many amateurs stop, slow or push outward the leading shoulder on the forward swing, allowing the trailing shoulder or the arms to take over the swing. This phenomenon is known as an "arms only" swing and leads to an outside-in swing path, which causes the club face to open at impact (pointing right of the target for the right-handed player), resulting in either a weak slice or push shot. A related problem is a breakdown of the angles presented by the triangle formed by the shoulders, forearms and hands.

In accordance with the present invention, it has been determined that the optimal placement of the spacing member is not above or on the outside of the elbows, or at the wrists or lower forearms, but high and on the inside of the forearms. Placing the spacing member in this position will ensure that the energy generated by the trailing shoulder (i.e., the right shoulder for a right handed player) on the forward swing fully transfers to the leading shoulder, thereby curing the "arms only" swing". Such a placement allows for the closest placement of the member to the energy source (the shoulders) without restricting the shoulder turn.

Placement of a rigid spacing member above the elbows prevents a full shoulder turn and prevents a wide take-away with a leading right elbow, both of which are keys to a powerful golf swing. (See Golf Magazine, p. 28, Jan. 30, 1997). In contrast, a low placement of a rigid spacing member, such as at or near the wrists, transfers energy into the leading shoulder less efficiently on the forward swing because the fulcrum (the spacing member) is located further from the energy source (the trailing shoulder). Placement of a training device at or near the wrists should also be avoided to allow supination and pronation of the wrists as needed.

Persons knowledgeable in the art will also recognize that a flexible or semi-rigid spacing device results in a less efficient transfer of energy than a fully rigid member. It is axiomatic that force is more efficiently transferred by concentration in a smaller surface area than if dissipated over a larger surface area. Thus, in accordance with the present invention, it has been determined that a substantially rigid spacing member of relatively small diameter will thus transfer energy more efficiently than a spacing member which is spread over the entire forearm area. Also, a breakdown of forearm spacing is possible if a spacing member is placed at the apex (i.e., at the wrist area) of the triangle formed by the arms and shoulders, rather than at the midpoint of the triangle thus formed (i.e. just below the elbows).

In addition, in accordance with the present invention, it has been determined that placement of the device relatively high on the arms and concentrating energy into a smaller area assists the golfer in producing a "late hit", which has been recognized by some as a key factor in producing power and distance. A late hit occurs when the golfer's arms and hands are ahead of or at (and not behind) the club head on impact. A relatively high placement of the fulcrum aids in pushing the forearms ahead of the hands, causing the club head to lag behind beneficially. A small-diameter fulcrum, concentrating energy as high as possible on the forearms, further aids in this phenomenon.

Secondary benefits of utilizing a spacing member of small diameter placed just below the elbows and within the forearms have also been observed in utilizing the device of the present invention. First, placement of the device within the forearms permits the trailing elbow to fully contract, thereby promoting a fuller swing. Second, the training device of the present invention physically contacts the player's body over only a very small area, which will make it easy for the player to transition from wearing the device to swinging without it. Third, the present invention implements a small diameter, tubular spacing member terminating within both forearms, which is aerodynamically efficient, due to the fact that the member is fully sheltered by the leading arm on the down swing. Fourth, the device of the present invention is compact, portable and easy to wear, which enhances performance and utility.

SUMMARY OF THE INVENTION

The present invention provides a golf swing training device which allows the relative angulation of the leading and trailing forearms with respect to each other to change in some respects during the swing while substantially maintaining the distance between the forearms throughout the swing. The device comprises a spacing member having a leading end and a trailing end and a fastening strap attached to each of the ends. The straps couple the device to the trainee's forearms and hold the spacing member between and against the insides of the forearms during the golf swing.

In accordance with the preferred embodiment of the present invention, the strap attached to the leading end, which is referred to herein as the leading forearm strap, has ends which can be connected and disconnected via a fastening device. Preferably, this strap is adjustable in length. The leading forearm strap attaches to the leading forearm at the elbow extensor muscle, located just below the elbow. The spacing member preferably is a rigid, tubular member which preferably is attached to the leading forearm strap by means a clip coupled with a 360° articulating joint. The joint preferably is fixedly attached to the leading end of the spacing member via a semi-circular loop which extends outward and away from the leading end of the spacing member. The clip is coupled to the joint in such a manner that the clip is allowed a wide range of movement within the joint, such as swiveling, pivoting and rotation.

Preferably, the strap that attaches to the trailing end of the spacing member, which is referred to herein as the trailing forearm strap, is made of an elastic material to allow some slight movement of the trailing forearm in a direction away from the spacing member during the golf swing. Preferably, this strap is formed of a loop and is not provided with a connector for unfastening the strap. Preferably, both ends of the trailing forearm strap are attached to the spacing member within the spacing member. This strap preferably is not intended to be fastened to and unfastened from the spacing member. Preferably, means are provided for allowing the golfer to adjust the length of this strap. Both forearm straps preferably can be placed and adjusted by the trainee without the assistance of another person.

In accordance with the preferred embodiment, the leading forearm strap is approximately 18" long and is of a "hook-and-loop" material, such as Velcro, or of a leather, fabric or other material covered with a similar type of hook and loop material, with the exterior surface exhibiting the hook material. The interior surface of the strap is covered with or contains the loop material. The clip attached to one end of the leading forearm strap preferably is a plastic, nylon, or metal clip. The clip preferably comprises three areas of attachment which are parallel to each other and which define two openings of similar size. One end of the leading forearm strap is permanently attached to one side of the clip at one of the three areas of attachment. The last 6"–8" of strap is of a "hook-and-loop" material, or of a leather, fabric or other material covered with a hook and loop material, with the exterior surface exhibiting the loop material. This end of the strap passes through the opposite opening in the clip and is folded over the clip so that the exterior surface exhibiting the loop material mates with the hook material. One area of attachment of the clip is centered between the other two areas of attachment. Preferably, the 360°, articulating joint attaches to this center area of attachment of the clip to allow the clip to move freely within the articulating joint without the ends of the straps interfering with the movement of the clip.

In accordance with a second embodiment of the present invention, the articulating joint comprises a plastic, nylon, metal or similar ball-and-socket joint that is attached by its base to the spacing member. In accordance with a third embodiment of the present invention, the articulating joint comprises a ball-bearing or similar 360° floating head which is seated on and attached to the end of the spacing member and the clip attaches to the articulating joint.

In accordance with all three of these embodiments, the articulating joint "floats" to maintain a relatively perpendicular relationship between the spacing member and the forearms throughout the swing. The base of the articulating joint (whether of hook, ball-and-socket, ball-bearing, or other variety) preferably is of a size and shape which allows it to slide inside the leading end of the spacing member. Thus, the outside diameter of the base of the articulating joint preferably is slightly less than the inside diameter of the spacing member. In accordance with the preferred embodiment, the base of the articulating joint has an opening sufficiently large to allow the ends of the elastic trailing forearm strap to pass through the opening and be fixedly held therein via a friction fit. In accordance with one embodiment, the base of the articulating joint is affixed to the spacing member via a screw shank, pin or rivet which runs from one side of the spacing member through an opening in the base and into the other side of the spacing member. In accordance with a second embodiment, the base is affixed to the spacing member by an adhesive material.

In accordance with the preferred embodiment of the present invention, the length of the spacing member is adjustable in length to accommodate different spans between golfers' forearms. This is preferably accomplished by comprising the spacing member of two concentric sliding elements, one of which has an inner diameter which is larger than the outer diameter of the other. Each sliding element is between 3" and 4" in length. When coupled together, the length of the spacing member is expected to vary from between 3.5" and 6" in length, although overall shorter and longer dimensions are possible, as will be understood by those skilled in the art. The interior sliding element (male piece) preferably is approximately 3/4" in outside diameter and preferably attaches to the leading forearm strap by means of the articulating joint. The exterior sliding element preferably is approximately 1" in outside diameter and attaches to the trailing forearm by an elastic strap. Suitable padding is provided at each end of the tube to protect the golfer's arms.

Coupling of the male and female sliding elements may be accomplished in a variety of manners. In accordance with one embodiment, an extension spring runs from the articulating joint inside the interior sliding element to a fixed post attached to the exterior sliding element. In accordance with a second embodiment, coupling of the sliding members is accomplished using the same elastic strap which attaches about the trailing forearm. In accordance with this embodiment, the ends of the strap are placed under tension and attached to a fixed post on the exterior sliding element. In accordance with a third embodiment, a compression spring is provided which runs between the base of the articulating joint and terminates at a horizontal surface inside the exterior sliding element. Separation of the interior and exterior sliding elements is prevented via a flange or similar stopping device inside the interior sliding element.

Several different arrangements may be used for adjusting the length of the spacing member. In accordance with one embodiment, a single hole is bored in the wall of the exterior element and a plurality of holes are bored in the wall of the interior sliding element. A knob of small diameter is affixed to a screw or bolt shank which enters the hole in the exterior sliding element and mates with a selected hole in the interior sliding element. In accordance with a second embodiment, a tubular plunger locking mechanism with a spring-biased plunger is received in a hole bored in the wall of the interior sliding element. In a similar embodiment, a flat plunger device that is oval or round in profile is received in a slot formed in the wall of the interior sliding element. Formed in the wall of the exterior sliding element are, depending on the alternative embodiment, successive holes or slots for receiving the round or flat plunger locking device. In accordance with a fourth embodiment, the end of the outer tube biased toward the leading forearm is threaded to receive a locking hand nut. A nylon or similar compression washer fits between the two tubes. The washer may be toothed with appropriate slots formed in the wall of the inner tube to receive the washer.

In accordance with the preferred embodiment, the length of the elastic strap (loop) may be adjustable by means of a buckle or similar type of adjusting device attached to the interior and exterior sliding elements. In accordance with one embodiment, a slotted spindle is formed on the inside of the exterior sliding element through which one end of the elastic loop may pass. The spindle is attached to the exterior wall of the exterior sliding element by a screw or bolt shank or pin. A hole is bored in the opposite side of the exterior sliding element to accept a spring-biased plunger. Slots are also formed on the exterior wall of the exterior sliding element to accept a locking plunger head. In this way, the plunger head is lifted, rotated clockwise or counter clockwise, and then dropped it into the plunger slot to allow the strap to be lengthened or shortened and then fixed at the new length.

DETAILED DESCRIPTION OF THE PREFERRED EMBODIMENTS

The invention will now be described in relation to the preferred embodiments of the present invention. It will be understood by those skilled in the art that the present invention is not limited to these embodiments. It will be understood by those skilled in the art that the present invention can be accomplished in a variety of different ways. For example, the manner in which the interior and exterior sliding elements are adjusted and locked into place to enable the length of the training device to be adjusted can be accomplished in a variety of ways other than those expressly discussed herein. Furthermore, the spacing member of the training device of the present invention can be comprised of a single substantially rigid member which is not adjustable in length. Similarly, the manner and arrangement by which the straps are attached to the spacing member can be accomplished in a variety of different ways, as will be understood by those skilled in the art. Also, the present invention is not limited with respect to the type of material with which the straps are made.

Figure 1B:
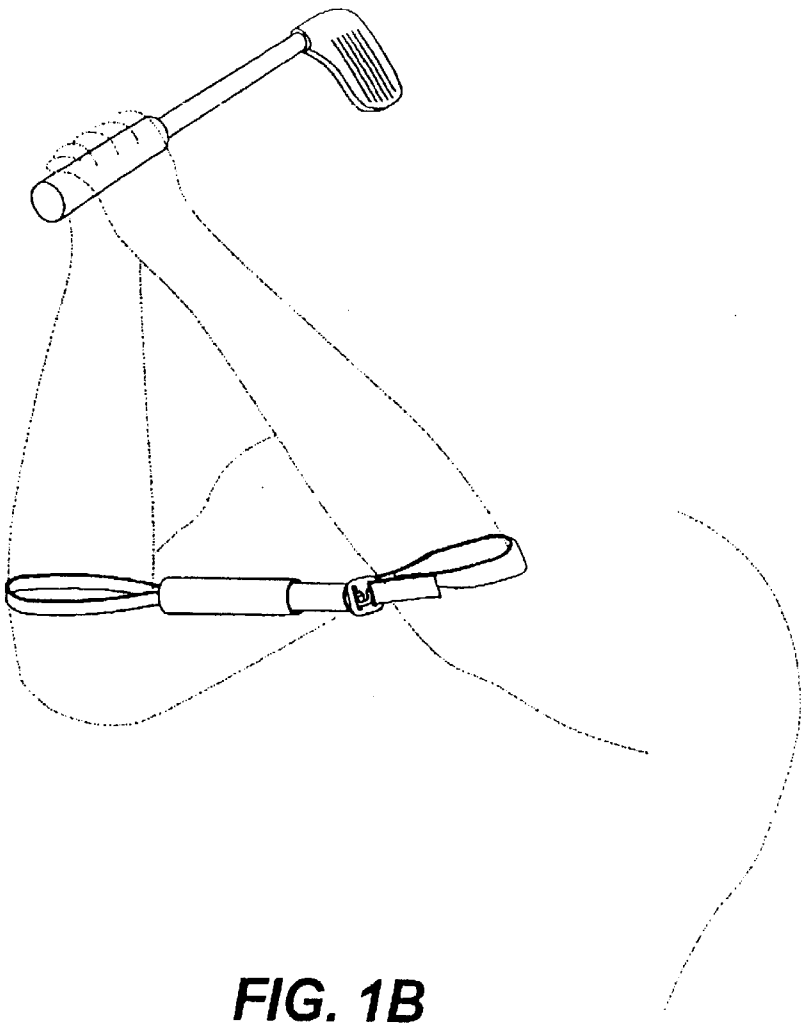
FIG. 1B illustrates a golfer wearing the golf swing training device in the present invention at the top of the back swing.
Figure 1A:
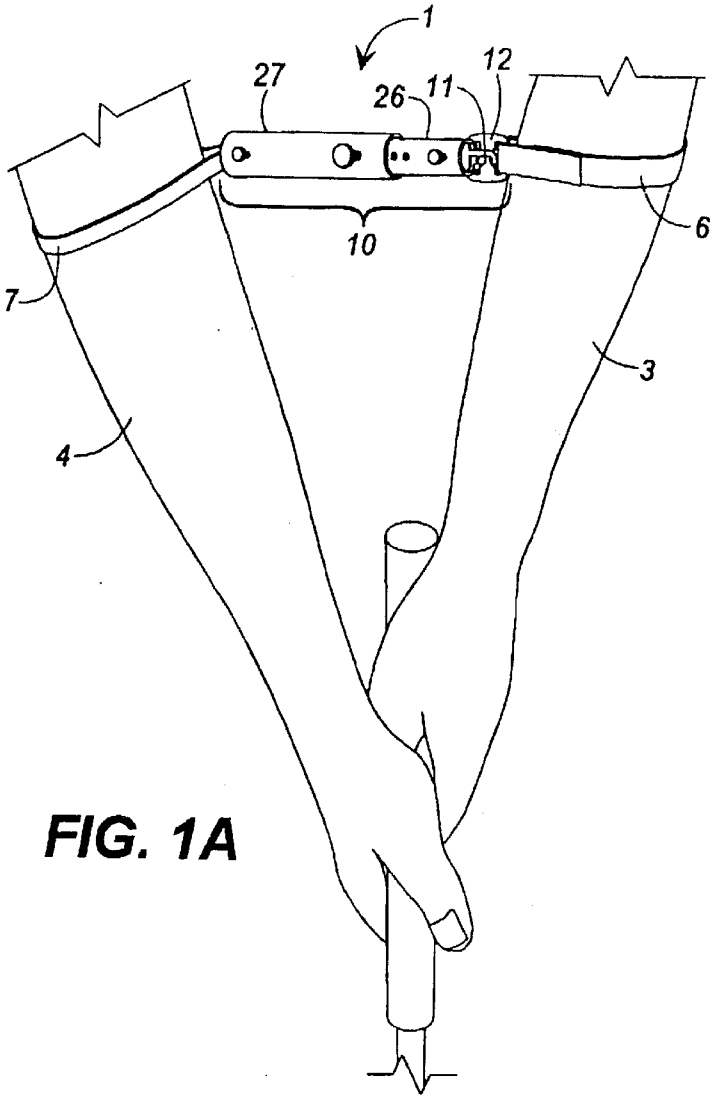
FIG. 1A illustrates a golfer wearing the golf swing training device of the present invention wherein the golfer is at the address position.

FIG. 1A illustrates the training device 1 of the present invention attached to the leading and trailing arms 3 and 4, respectively, of a golfer at the address position. FIG. 1B illustrates the training device 1 of the present invention attached to the golfer wherein the golfer is at the top of the back swing. The training device 1 includes a strap 6 which can be attached about the leading forearm 3 and a strap 7 which can be attached about the trailing forearm 4. Preferably, the strap 6 is an adjustable hook-and-loop or similar type of strap which attaches to the leading forearm 3 at the elbow extensor muscle, located just below the elbow. A substantially rigid spacing member 10 is attached to the leading forearm strap 6 via a clip 12 which is mechanically coupled to a 360° articulating joint 11, as discussed in more detail below with respect to FIG. 2. The spacing member 10 attaches to the trailing forearm 4 below the elbow and above the wrist via strap 7, which preferably is an elastic loop. Both forearm straps 6 and 7 can be placed about the forearms 3 and 4 of the golfer and adjusted without the assistance of another person.

Figure 5:
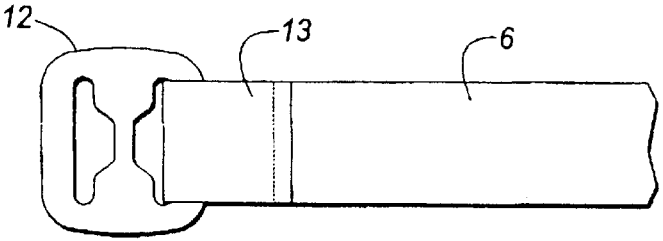
FIG. 5 illustrates a section of the strap and clip that secures the golf swing training device shown in FIG. 1B to the leading forearm of the golfer.

The leading forearm strap 6 preferably is approximately 18 inches long and is of a hook-and-loop material, such as Velcro, or of a leather, fabric or other material covered with a hook-and-loop material, with the exterior surface of the strap 6 having the hook material thereon and the interior surface of the strap 6 having the loop material thereon. One end of the strap 6 is attached to a plastic, metal or similar clip 12 which preferably is the approximate width of the strap 6. The clip 12 preferably has an elevated cross member which forms two openings and three areas of attachment, as discussed in more detail below with respect to FIG. 3. The strap 6 preferably is permanently attached to one side of the clip 12, as shown in FIG. 5, via a sewed loop formed of a portion of strap 6. Preferably, only the last 6 to 10 inches of the exterior side of the strap 6 comprises the loop material. This portion of the strap passes through the opposite side of the clip and is folded over the clip 12 so that the loop material mates with the hook material. In this manner, the overall strap length is adjustable.

Figure 2:
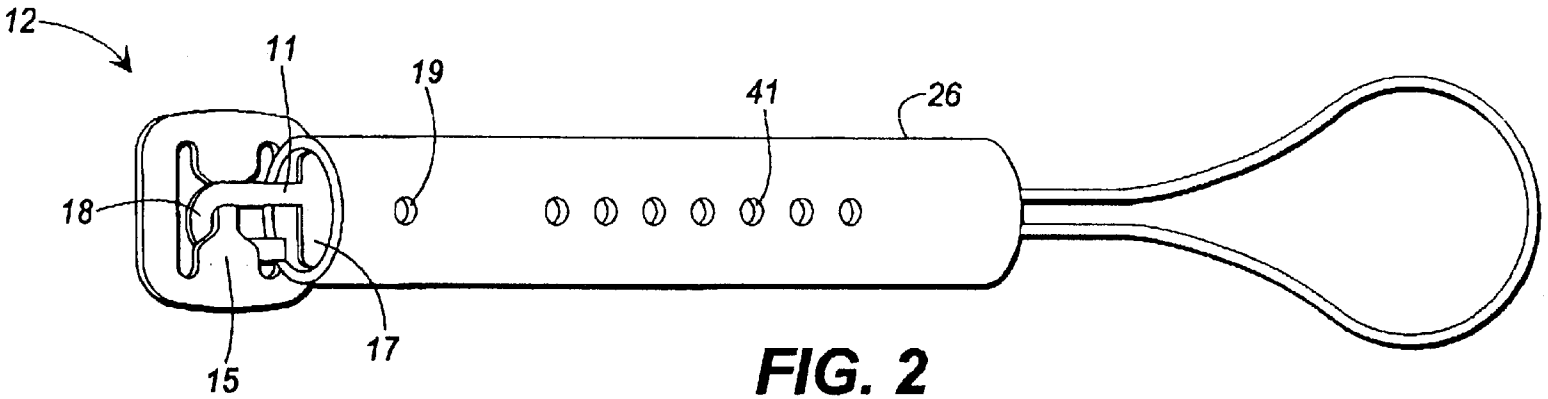
FIG. 2 illustrates the interior sliding element of the golf swing training device shown in FIG. 1B.

FIG. 2 is an enlarged view of the interior element 26 of the device 1. In FIG. 2, the leading forearm strap 6 is not shown so that details of the clip 12 can be easily seen. The 360° articulating joint 11 attaches to the elongated or center portion 15 of the clip 12, which is connected to the leading forearm strap 6. The base 17 of the articulating joint 11 attaches to the interior element 26 of the rigid spacing member 10. In accordance with the preferred embodiment, the articulating joint 11 comprises a plastic, nylon, metal or similar type of hook 18 that slips over a center portion 15 of the clip 12 and is seated within interior element 26 to prevent detachment. In accordance with a second embodiment of the invention, a plastic, nylon, metal or similar ball-and-socket joint (not shown) is attached or made a part of the clip 12, with the base of the articulating joint 11 attaching to the interior element 26 of the spacing member 10. In accordance with a third embodiment, the clip 12 attaches to a ball-bearing or similar 360° floating head (not shown) which is seated on the end of the interior element 26. As stated above, a common feature of all three embodiments is that the joint "floats" to maintain a perpendicular relationship between the spacing member 10 and the forearms 3 and 4 throughout the swing.

Figure 6:
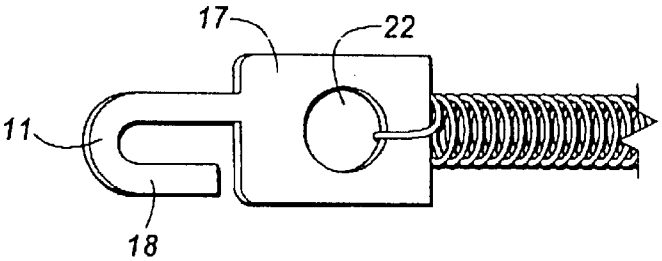
FIG. 6 illustrates a side view of an the articulating joint which couples the strap shown in FIG. 5 to the golf swing training device shown in FIG. 1B.

The base of the articulating joint 11 preferably is of a size and shape which allows it to slide inside the interior element 26 of the spacing member 10, regardless of whether it is comprised of a hook, a ball-and-socket arrangement, a ball bearing arrangement, or some other arrangement. Thus, the outside diameter of the base 17 is slightly less than the inside diameter of the interior element 26 of the spacing member 10. In accordance with the preferred embodiment, the base 17 has an opening 22 formed therein, as shown in FIG. 6, which is sufficiently large to allow attachment of the ends of the elastic loop 7 which is placed about the trailing forearm 4 to the base 17. In accordance with this embodiment, the base 17 is affixed to the spacing member 10 via a screw shank, pin, rivet, or some other suitable fastening device, which is represented by numeral 19 in FIG. 2. The fastening device 19 passes through the interior element 26 from one side of the interior element 26 to the other side of the interior element 26. The fastening device also passes through the opening 22 of the base 17 to thereby hold the base 17 in place. The elastic strap 7, which is intended to be secured to the trailing arm of the golfer, has a first end and a second end (not shown), each of which are secured in place at the opening 22 via a friction fit. The friction fit is created by the tight fit of the ends of the strap within the opening 22 and by the passing of the fastening device through the opening 22. Alternatively, the base 17 may be affixed to the spacing member 10 by an adhesive material (not shown).

Figure 3:
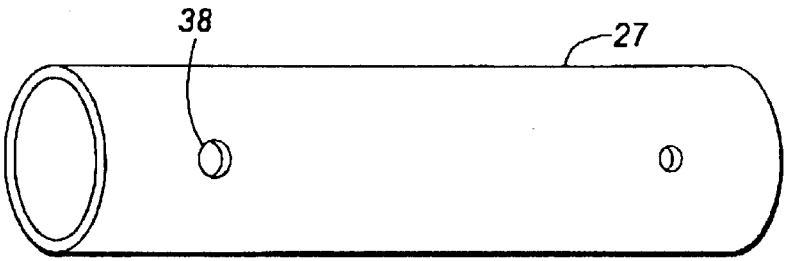
FIG. 3 illustrates the exterior sliding element of the golf swing training device shown in FIG. 1B.

Referring again to FIG. 1, the spacing member 10 preferably is cylindrical in shape and has two sliding elements 26 and 27 to allow for adjustability in length to accommodate different spans between golfers' forearms. Each sliding element preferably is between 3 and 4 inches in length. When coupled together, the length of the spacing member is expected to vary from between 3.5 inches and 6 inches in length, although overall shorter and longer dimensions may be used as well, as will be understood by those skilled in the art. The interior sliding element 26 is approximately 3/4" in outside diameter and attaches to the leading arm strap 6 via the clip 12 and articulating joint 11, as discussed above. The exterior sliding element 27, which is shown by itself in FIG. 3, is approximately 1 inch in outside diameter and is attached to the trailing forearm 4 by the elastic strap 7. Preferably, suitable padding (not shown) is provided at the end of element 27 that is adjacent the golfer's trailing forearm to protect it from injury or irritation.

Figure 7:
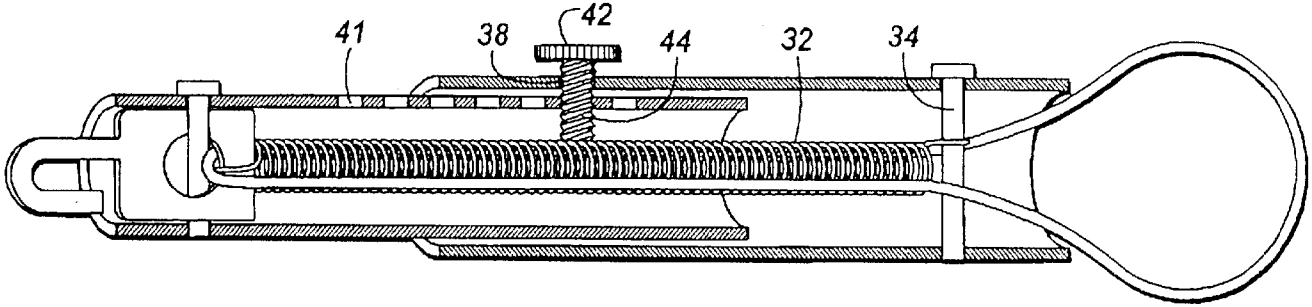
FIG. 7 illustrates a cross-sectional, cut away view in the longitudinal direction of the golf swing training device shown in FIG. 1B which shows a spring used to couple the interior sliding element shown in FIG. 2 to the exterior sliding element shown in FIG. 3 and to bias the sliding elements towards one another.

Coupling of the exterior and interior sliding elements 26 and 27 together can be accomplished in a variety of ways. In accordance with one embodiment, which is shown in FIG. 7, an extension spring 32 runs from the articulating joint inside the interior sliding element 26 to a fixed post 34 mounted to the exterior sliding element 27. Alternatively, coupling of the interior and exterior sliding elements 26 and 27 may be accomplished using the elastic strap 7 which secures the device 1 to the trailing forearm. In this embodiment, the ends of the strap 7 are attached to the articulating joint 11 in the manner discussed above. The strap 7 is then attached to the fixed post 34 mounted to the exterior sliding element 27 at locations on the strap 7 in between the ends of the strap 7 attached to the articulating joint 11 and the loop formed by the strap 7. The tension created in the strap 7 between the ends attached to the articulating joint 11 and the locations at which the strap 7 is attached to the fixed post 34 biases the interior and exterior sliding elements 26 and 27 towards one another in a spring-like manner.

Alternatively, a compression spring (not shown) may be provided which is attached to the base of the articulating joint 11 on one and of the spring and to a horizontal surface inside the exterior sliding element 27 on the other end of the spring. The force of the spring tends to bias the sliding elements 26 and 27 away from one another and separation of the sliding elements 26 and 27 is prevented by means of a flange (not shown) or similar stopping device inside the interior sliding element 27. It will be understood by those skilled in the art that virtually an infinite number of arrangements could be used to enable the sliding elements 26 and 27 to be adjusted in position with respect to each other and then secured in the desired position. The present invention is not limited to any particular arrangement for accomplishing this feature of the present invention.

Figure 4:
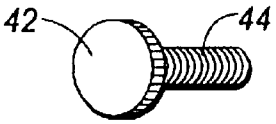
FIG. 4 illustrates a knob attached to a screw or bolt shank which is used to secure the relative positions of the interior sliding element shown in FIG. 2 to the exterior sliding element shown in FIG. 3.

Several different arrangements may be implemented for adjusting the length of the spacing member 10, as will be understood by those skilled in the art. In accordance with one embodiment, a single hole 38 is bored in the wall of the exterior sliding element 27 and a plurality of holes 41 are bored in the wall of the interior sliding element 26. This can be seen in FIGS. 2 and 3. A knob 42 of small diameter, which is shown in FIG. 4, is affixed to a screw or bolt shank 44 which enters the opening 38 in the exterior element 27 and mates with the selected opening 41 in the interior sliding element 26, as shown in FIG. 7. Other arrangements, such as a spring-biased tubular plunger locking mechanism which is received in a hole bored in the wall of the interior sliding element 26 may also be used. Alternatively, a flat plunger device having an oval or round profile may be received in a slot formed in the wall of the interior sliding element 26. In this latter arrangement, successive holes or slots for receiving the round or flat plunger locking device are formed in the wall of the exterior sliding element 27. Alternatively, the end of the outer exterior sliding element 27 disposed adjacent the leading forearm may be threaded to receive a locking hand nut. A nylon or similar compression washer then fits between the two sliding elements 26 and 27. The washer may be toothed with appropriate slots formed in the wall of the interior sliding element 26 to receive the washer.

Preferably, the length of the elastic strap 7 may be made adjustable. This may be accomplished by implementing a buckle or similar type of device attached to the interior or exterior sliding elements 26 and 27 which is used to take up or let out the strap 7. In accordance with one embodiment, a slotted spindle (not shown) is attached to the inside of the exterior sliding element 27 through which one side of the elastic strap 7 passes. The spindle may be attached to the exterior wall of the interior sliding element 26 by a screw or bolt shank or pin at or near the fixed post 34 mounted to the exterior sliding element 27. A hole is bored to the opposite side of the exterior sliding element 27 to accept a spring-biased plunger (not shown). Slots are also formed on the exterior wall of the exterior sliding element 27 to accept a locking plunger head (not shown). To adjust the length of the strap 7, the plunger head is lifted, rotated clockwise or counter clockwise, and then dropped it into the plunger slot once the desired length has been achieved.

It will be understood by those skilled in the art that the present invention has been described with respect to the preferred embodiments but that the present invention is not limited to these embodiments. Other modifications to the present invention may be made which are within the scope of the present invention.

What is claimed is:

1. A golf swing training device which attaches to the inside of both upper forearms just below the elbows of a golfer, the golf swing training device for use by a golfer to train the golfer to correctly execute a full golf swing, the device comprising:

a spacing member having a leading end and a trailing end;

a trailing arm securing device, the trailing arm securing device being coupled to the trailing end of the spacing member, the trailing arm securing device for securing the trailing end of the spacing member to the trailing forearm of the golfer; and a leading arm securing device for securing the leading end of the spacing member to the leading forearm of the golfer, the leading arm securing device being coupled to the leading end of the spacing member by a coupling device, the coupling device allowing relative movement between the leading arm securing device and the spacing member such that the positions of the leading and trailing forearms with respect to each other are allowed to change during the full golf swing and wherein the spacing member maintains the distance between the forearms during the golf swing at points on the forearms at which the ends of the spacing member are in contact with the forearms.

2. The golf swing training device of claim 1, wherein the leading arm securing device is a strap having a fastening device which can be connected and disconnected from the coupling device to allow the golfer to attach and remove the strap from the leading forearm of the golfer.

3. The golf swing training device of claim 1, wherein the coupling device is an articulating joint secured to the leading end of the spacing member which allows rotational and pivotal movement of the spacing member with respect to the coupling device to thereby allow rotational and pivotal movement of the golfer's leading forearm with respect to the golfer's trailing forearm.

4. The golf swing training device of claim 3, wherein the trailing forearm securing device is an elastic strap which secures the trailing forearm of the golfer to the spacing member.

5. The golf swing training device of claim 1, wherein the spacing member is adjustable in length, the spacing member comprising an interior element and an exterior element having a common longitudinal axis, the interior element and the exterior element being adjustable with respect to each other in the longitudinal axial direction to thereby adjust the length of the spacing member to accommodate varying spans between different golfers' forearms, the spacing member comprising a locking mechanism for locking the interior and exterior elements at a selected position to prevent movement of the interior and exterior elements relative to each other in the longitudinal axial direction.

6. The golf swing training device of claim 5, wherein the length of the spacing member is adjusted by aligning a selected one of a plurality of openings formed in the exterior element with an opening formed in the interior element and by inserting a pin into the selected opening formed in the exterior element and into opening formed in the interior element, wherein said pin, said selected opening formed in the exterior element and said opening formed in said interior element together comprise said locking mechanism.

* * * * *